United States Patent [19]

DiBlasio

[11] 4,313,598

[45] Feb. 2, 1982

[54] SELF-COMPENSATING STRIPPER ASSEMBLY FOR DOCUMENT HANDLING AND COUNTING APPARATUS

[75] Inventor: John A. DiBlasio, Medford, N.J.

[73] Assignee: Brandt-Pra, Inc., Cornwells Heights, Pa.

[21] Appl. No.: 70,666

[22] Filed: Aug. 29, 1979

[51] Int. Cl.[3] ..... B65H 3/52

[52] U.S. Cl. ..... 271/124; 271/37; 271/119

[58] Field of Search ..... 271/124, 125, 121, 119, 271/120, 122, 123, 34, 35, 104, 138, 167, 109, 37; 414/123, 124, 129, 130

[56] References Cited

U.S. PATENT DOCUMENTS

| | | | |
|---|---|---|---|
| 685,370 | 10/1901 | Bridgewater | 271/119 |
| 1,169,352 | 1/1916 | Rees et al. | 271/35 UX |
| 2,224,138 | 12/1940 | Trydal | 271/37 |
| 3,771,783 | 11/1973 | McInerny | 271/125 |
| 3,991,998 | 11/1976 | Banz et al. | 271/125 |

FOREIGN PATENT DOCUMENTS

| | | | |
|---|---|---|---|
| 2356602 | 6/1974 | Fed. Rep. of Germany | 271/121 |

*Primary Examiner*—Bruce H. Stoner, Jr.
*Attorney, Agent, or Firm*—Weinstein & Sutton

[57] ABSTRACT

A self-compensating stripper assembly cooperating with a feed roller for separating sheets from a stack and feeding them one-at-a time to facilitate counting, examining and endorsing operations on each individual sheet. Said assembly has a pivotally mounted stripper member positioned upon the free end of a swingable arm. A resilient element urges the swingable arm toward the feed roller and an adjustable stop limits the movement of the stripper assembly toward the feed roller. An additional independent resilient member urges the stripper member toward the feed roller and is yieldable to accommodate changes in sheet thickness. The shape of the stripper member facilitates the stripping operation by shaping the stack of sheets prior to entry into the stripping operation. Separate stops are provided for limiting the pivotal movement of the stripper member about its pivotal mounting.

25 Claims, 4 Drawing Figures

30'
30
60

SELF-COMPENSATING STRIPPER ASSEMBLY FOR DOCUMENT HANDLING AND COUNTING APPARATUS

BACKGROUND OF THE INVENTION

The present invention relates to sheet handling and counting apparatus and more particularly to a novel self-compensating stripper assembly for sheet handling and counting apparatus to facilitate the stripping operation.

High speed document handling and counting apparatus is finding more widespread use, especially in banks and other like institutions where it is desired to count, authenticate and endorse documents such as checks and paper currency both accurately and at high speed.

One such apparatus is disclosed in U.S. Pat. No. 3,771,783 issued Nov. 13, 1973 assigned to assignee of the present application as described therein, the document handling apparatus employs a sheet separating assembly comprised of a drive wheel and a cooperating stripper wheel. The drive wheel rotates in a direction to move the sheets in a forward feed direction. The stripper wheel is rotated so that the peripheral portion which engages the sheet fed to the drive wheel moves in a direction reverse that of the forward feed direction. The coefficient of friction of the peripheries of the drive and stripper wheels are of different values which values are selected to cause the drive wheel to have the prevailing influence upon sheets fed therebetween. However, with respect to double-fed or multiple-fed sheets, the sheet engaging the drive wheel is moved in the forward feed direction while the sheet engaging the stripper wheel is moved in a direction opposite the forward feed direction to thereby assure the feeding of single sheets through the sheet separation assembly.

The stripper assembly thus requires driving means and further is subjected to wearing due to the frictional engagement between the rotating stripper wheel and the sheets being fed thereto.

Also, no means are provided for enabling the stripper wheel to be abruptly displaced relative to the feed wheel due to a jammed condition.

Another technique employed in the prior art for separating sheets utilizes a stationary member having a knife edge positioned above a feed means by a distance sufficient to allow passage of single sheets and insufficient to allow the passage of double fed sheets. Although this technique is effective for stiff and/or thick sheets, such as punch cards, thin, lightweight and fragile documents are highly susceptible to being torn by the stationary member. In the case where two documents are stuck together, the knife edge will often cause one or more of the sheets to be damaged or torn.

Therefore, it is highly desirable to provide means for feeding and separating sheets at high speeds in an accurate manner without damaging the sheets being processed and through the employment of a simple and yet rugged and reliable apparatus.

BRIEF DESCRIPTION OF THE INVENTION

The present invention achieves the above objectives through the use of a novel stripper assembly cooperating with a feed roller, said assembly being comprised of a swingable mounting arm and a stripper means pivotally mounted to the free end of said arm. First bias means normally biases the mounting arm to urge its free end toward the feed roller. Second independent biasing means normally biases the stripper means toward the feed roller and is further yieldable to compensate for differences in document thickness and tolerances in the stripper assembly components and to allow a plurality of documents to become wedged therebetween without damaging the stripper assembly.

Adjustment means are provided for adjusting the angular position of the mounting arm to thereby locate the stripper means so that the stripper member may be located at a position of engaging the feed roller to a position displaced a predetermined maximum distance therefrom. Separate adjustment means are also provided for angularly positioning the pivotally mounted stripper means relative to the feed roller.

The stripper means is preferably formed of a rigid pivotally mounted stripper mounting block having releasably secured thereto a resilient stripper block with an inclined upstream surface which facilitates the smooth feeding of sheets by shaping the stack of sheets moving against the stripper member to conform to the inclined surface and thereby facilitate the stripping operation.

The stripper member and feed roller are formed of resilient materials having respectively smaller and larger coefficients of friction so that the feed roller exerts the prevailing driving influence upon a single sheet fed between the stripper block and feed roller. Additional resilience may be obtained for the feed roller by providing the feed roller with a tooth-like surface.

Lever means are provided for imparting an additional force upon the stripper means when handling very stiff documents or sheets. Alternatively the lever means may be utilized to release the stripper means from the feed roller to clear a jam condition.

Highly effective and reliable stripping is thus obtained through a novel stripper assembly which combines the best features of a knife-edge stripper means plus the inclined upstream shaping surface to assure high speed feeding and stripping of documents and/or sheets without the need for a constantly rotating stripper means.

OBJECTS OF THE INVENTION AND BRIEF DESCRIPTION OF THE FIGURES

It is therefore one object of the present invention to provide novel stripper means for use in document handling and counting apparatus in which mounting means including suitable biasing means is provided to automatically compensate for tolerance differences in the stripper assembly components and for variations in document thickness during feeding and stripping operations.

Still another object of the present invention is to provide a novel stripper means for use in sheet handling and counting apparatus in which said stripper means is pivotally mounted upon a swingable arm and including means respectively biasing said arm and said pivotally mounted stripper member to automatically compensate for changes in the thickness of sheets passing between the stripper means and a cooperating feed roller.

Still another object of the present invention is to provide novel stripper means for use in sheet feeding and counting apparatus and comprised of a resilient stripper member which is designed to shape a stack of documents being fed thereto to facilitate feeding and stripping of the sheets in the stack.

Still another object of the present invention is to provide novel stripper means for use in sheet feeding and handling apparatus in which the mounting assembly for the stripper means is provided with means for adjusting the position of the stripper means relative to a cooperating feed roller in order to accommodate the feeding and stripping of sheets of varying thickness and strength.

The above as well as other objects of the present invention will become apparent upon consideration of the accompanying description and drawing, in which.

Figure 1:
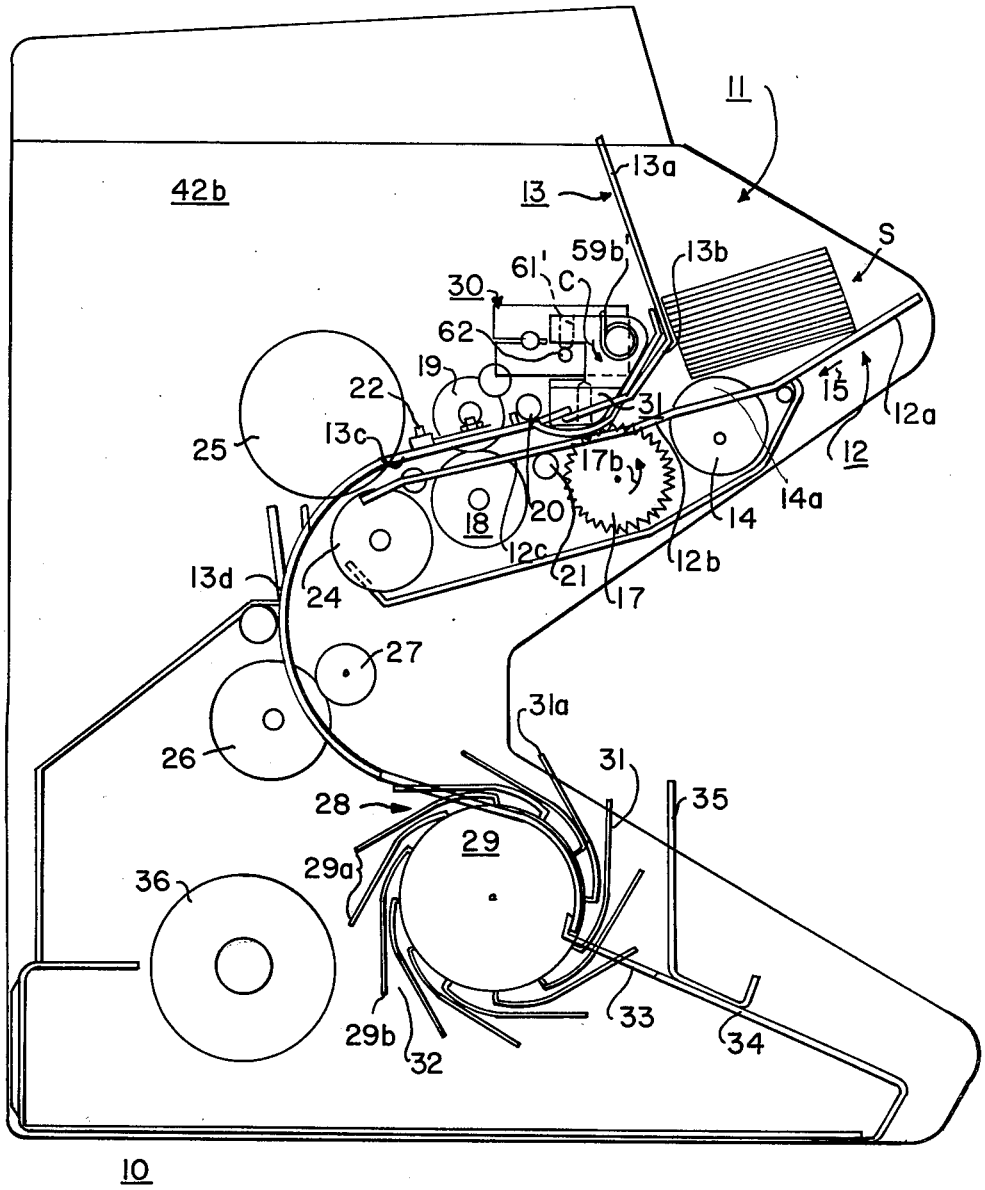
FIG. 1 shows an elevational view of a sheet handling and feeding apparatus embodying a stripper assembly of the present invention.
Figure 2:
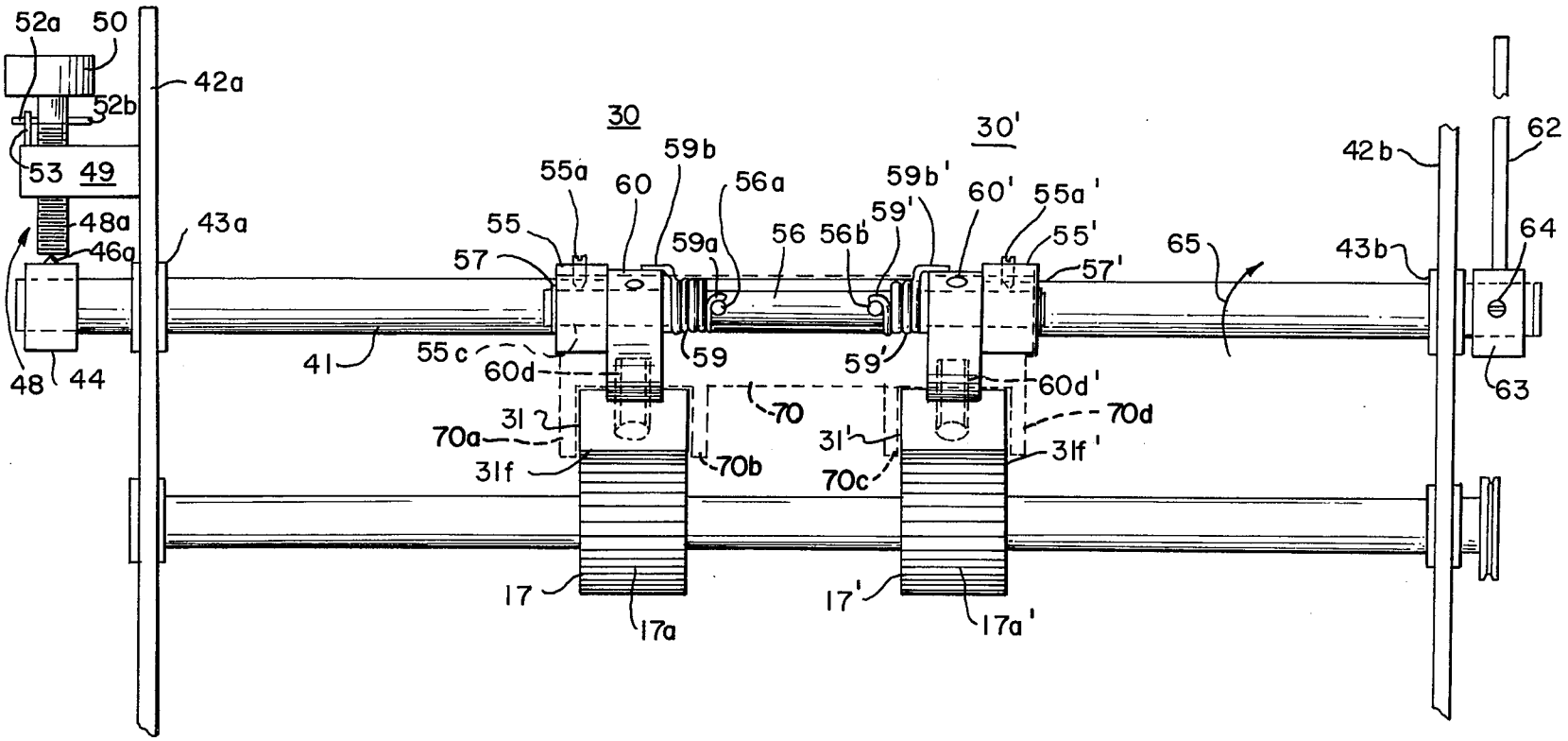
FIG. 2 shows a front elevational view of the stripper and feed roller assembly of FIG. 1.
Figures 3, 3A:
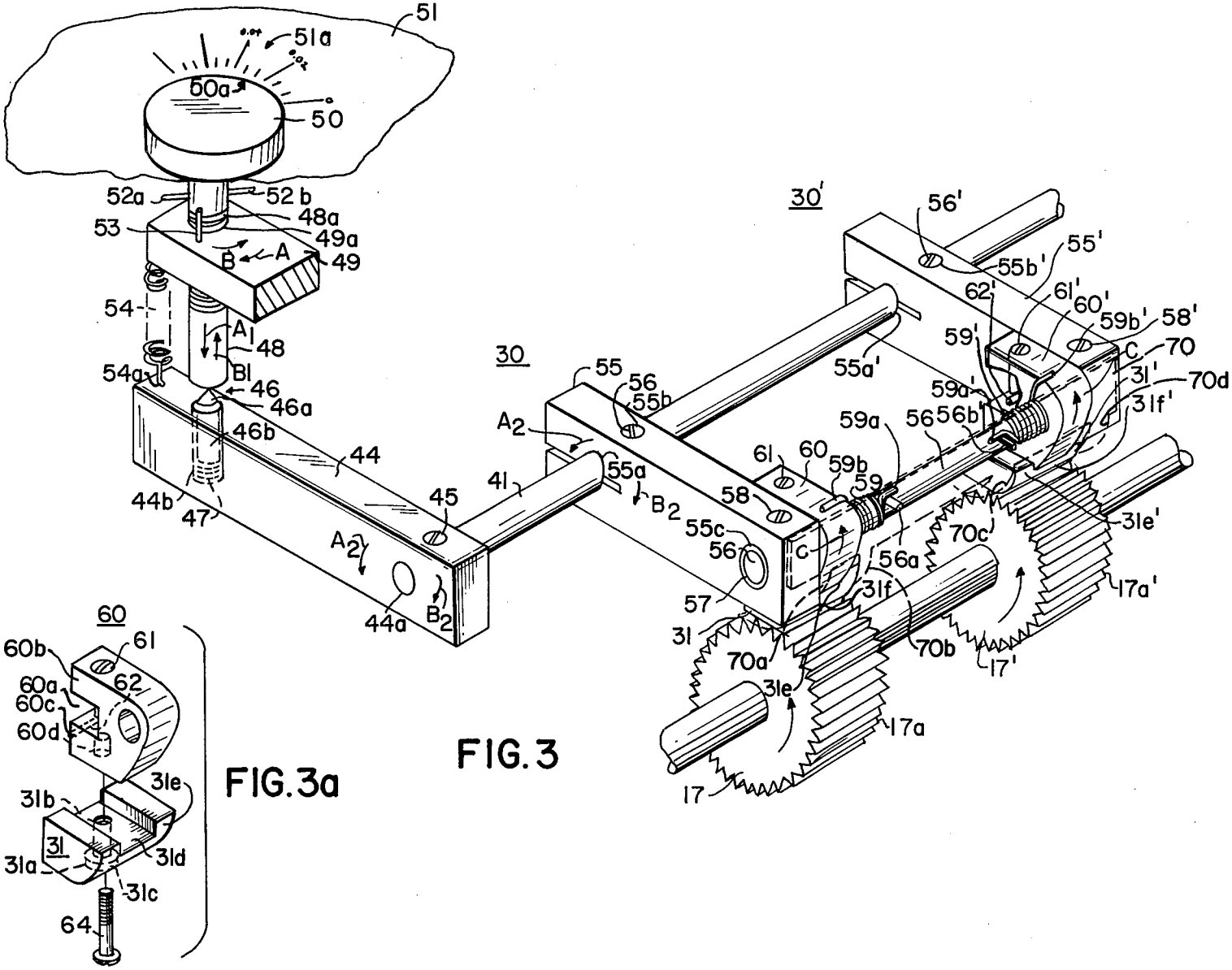
FIG. 3 shows a perspective view of the stripper and feed roller assembly FIGS. 1 and 2 showing the gap adjustment means employed for adjusting the position of the stripper member relative to the feed roller.

FIG. 3*a* is an exploded perspective view of one stripper assembly of FIGS. 1–3.

DETAILED DESCRIPTION OF THE INVENTION

FIG. 1 shows a sheet handling and counting apparatus 10 designed in accordance with the principles of the present invention and which is adapted to handle and count paper currency, checks, coupons, and other like documents as well as sheets and cards, such as punch cards, and which is further capable of endorsing and/or cancelling such documents as well as examining documents such as paper currency to detect the presence of suspect currency.

Major components of the apparatus are basically similar to those described in detail in U.S. Pat. No. 3,771,783 and assigned to the assignee of the present application and hence a detailed description of the invention is omitted for purposes of simplicity.

Briefly describing the major components of the document handling and counting apparatus 10, the apparatus 10 is a substantially lightweight portable device capable of being positioned upon any table or suitable support surface. The apparatus 10 comprises an input tray 11 adapted to receive and support a stack S of sheets such as for example paper currency, checks or the like.

Portion 12*a* of an elongated guide plate 12 serves as a supporting surface for the stack S of sheets. A second elongated guide plate 13 has a portion 13*a* which supports the leading edges of at least a portion of the sheets in the stack S.

The guide plate portion 12*a* is provided with an opening (not shown) through which a portion 14*a* of a constantly rotating picker roller 14 extends. The picker roller 14 is eccentrically mounted so that as it rotates, portion 14*a* periodically protrudes through the aforementioned opening in guide plate 12 to regularly "jog" the stack S of sheets and feed the bottommost sheet in the forward feed direction as indicated by arrow 15. The surface portion 14*a* of the picker roller 14 is a friction surface which is preferably formed of a material having a durometer to facilitate acceleration of the bottommost sheet in stack S in the forward feed direction.

Portions 13*b* and 12*b* of guide plates 12 and 13 respectively form a narrow tapering entrance throat which forms an entrance passageway for the bottommost sheet of stack S. The leading edge of a sheet passing through the entrance passageway enters into the nip formed between the stripper member 31 of stripper assembly 30 and feed roller 17 which rotates in the direction shown by arrow 17*b*. The operation of the cooperating stripper member 31 and feed roller 17 will be described hereinbelow in detail. However, for purposes of understanding the present description, it is sufficient to understand that the stripper block 31 and feed roller 17 cooperate to advance sheets one-at-a-time and in single file such that stripper block 31 and feed roller 17, each partially extend through cooperating openings (not shown) in their respective guide plates 13 and 12 and are positioned to form a nip into which sheets delivered from the infeed tray 11 enter. The durometers of the stripper block 31 and feed roller 17 are selected to cause feed roller 17 to impart the greater frictional drive upon a single fed sheet while the durometer of the material forming stripper member 31 imparts a lesser frictional force or "drag" upon the same sheet whereby the resultant force acts to drive the sheet in the forward feed direction 15. In the case of double-fed sheets, the frictional engagement between the engaging double-fed sheets is less than the frictional engagement between stripper block 31 and the upper of the two double-fed sheets so that the bottommost sheet is fed in the forward feed direction 15 while the top most sheet of the double-fed sheets is effectively restrained from movement at least until the bottommost sheet passes beyond the influence of feed roller 17. Thus it can be seen that stripper block 31 and feed roller 17 cooperate to permit only single fed sheets to pass downstream in a forward feed direction beyond the position occupied by members 31 and 17.

A constantly rotating acceleration roller 18 and a cooperating idler roller 19, each partially extend through openings (not shown) in portions 13*c* and 12*c* respectively of the guide plates 13 and 12 to form a nip through which sheets moving in the forward feed direction, and delivered by feed roller 17, are caused to pass. Sheets fed between acceleration roller 18 and cooperating idler 19 are abruptly accelerated to increase their linear velocity and thereby provide an increase in separation distance (i.e. gap) between the trailing edge of the sheet fed therethrough and the leading edge of the next sheet to be fed therethrough. This gap is detected by the document detector and doubles detector sensing means 20 cooperating with light source 21. An opening is provided in each of the plate portions 12 and 13*c* to enable light from light source 21 to impinge upon detector 20 in the presence of a gap between adjacent documents (i.e., in the absence of a sheet). Light of maximum intensity causes detector 20 to generate a signal which is employed for sheet counting purposes. This basic technique is described in detail in U.S. Pat. No. 3,771,783, mentioned hereinabove.

A doubles detection capability may also be incorporated as part of sensor means 20 which senses light intensity as a function of the transmittance of the documents or sheets passing therebetween. For example, the transmittance of two double-fed documents is significantly reduced as compared with the transmittance of a single document passing between light source 21 and sensor 20. A detailed description of of apparatus capable of performing double detection is set forth in detail in co-pending application, Ser. No. 865,316, filed Dec. 28, 1977, now U.S. Pat. No. 4,237,378 issued Dec. 2, 1980, and assigned to the assignee of the present application. Since the specific nature of such apparatus is beyond the scope of the present invention and since the invention described hereinbelow does not rely upon the nature of such devices for its successful operation, a detailed description of the doubles detection apparatus has been omitted herein for purposes of simplicity and a description of the doubles detection capability described in the last mentioned co-pending application is incorporated herein by reference thereto. It is sufficient for purposes of the present invention to understand that the doubles detection device may either provide a visual or audible alarm indicating a doubles condition or may additionally provide means for abruptly turning off the sheet handling apparatus 10.

In the event that it is desirable to examine documents such as paper currency for authenticity, the document handling apparatus 10 may further be provided with means 22 which preferably includes an ultraviolet lamp source and cooperating ultraviolet sensor for detecting ultraviolet light reflected from an irradiated document and, as described in co-pending application, Ser. No. 711,436, filed Aug. 4, 1976, now U.S. Pat. No. 4,114,804 issued Sept. 19, 1978, which has been assigned to assignee of the present invention, indicates a presence of a suspect bill. For purposes of the present invention, it is sufficient to understand that the wavelength of light emitted from an authentic piece of paper currency is different from the wavelength of light emitted from nonauthentic paper currency. The sensor incorporated in apparatus 22 monitors this condition and either generates an alarm indicative of the presence of the suspect bill or halts the document feeding operation, or both.

The document handling and counting apparatus 10 is further provided with a constantly rotating platen roller 24 cooperating with a rotating endorsing drum 25. Suitable openings (not shown) are provided in guide plates 12 and 13 within the region of the endorsing facility enabling portions of the roller 24 and endorsing drum 25 to partially extend within the aforesaid cooperating openings to form a nip through which single fed documents pass to permit printing thereon. An endorsing assembly including an endorsing drum is described in detail in co-pending application, Ser. No. 618,280, filed Sept. 19, 1975, now U.S. Pat. No. 4,054,092 issued Oct. 18, 1977, and assigned to the assignee of the present invention. For this reason a detailed description will be omitted herein for purposes of simplicity, said application being incorporated herein by reference thereto. The endorser drum 25 may be selectively moved into or displaced from the printing position and is typically adapted to imprint fixed and/or variable information on one side of a document (such as a check) passing therethrough. The apparatus may be employed either to cancel or endorse documents. When cancelling documents, the documents are placed upon infeed tray 11 of the document handling apparatus 10 so that the legend printed by the endorser drum 25 appears in the front face of the document. By reversing the alignment of the documents, the printing may be placed across the rear surface of the document. When it is desired to process documents without endorsing or cancelling, a suitable lever (not shown) is provided for displacing the endorsing drum 25 from the printing position. Platen roller 24 provides a rotating supporting surface for supporting the moving documents during printing.

After completion of the endorsing operation, sheets move between a second acceleration roller 26 and cooperating idler 27. The sheets follow the curved portion **13*d* of elongated plate 13 and enter into the nip formed by second acceleration roller 26 and cooperating idler roller 27. The sheets passing through the nip formed by rollers 26 and 27 are again abruptly accelerated and urged to follow the concave surface of curved plate portion 13*d* so that the leading edge of a sheet emerging from the nip between rollers 26 and 27 moves abruptly toward the concave surface of plate portion 13*d* almost immediately after leaving the aforesaid nip. The angle at the point of contact between the leading edge of the accelerated sheet and the tangent of the concave surface portion of the plate 13*d* at the point of contact is preferably in the range of 10 to 30 degrees to prevent even curled documents from becoming airborne and flying out of the apparatus and away from the stacker wheel assembly 28 which is comprised of a circular shaped stacker wheel 29 having a plurality of fingers 31 arranged in regularly spaced intervals about wheel 29**.

The fingers 31 are preferably formed of a resilient material and are curved so that adjacent fingers 31 cooperate to form a curved passageway or pocket 32 between each pair of curved fingers which pocket urges sheets entering into a pocket to assume a curved configuration conforming to the shape of the pocket which tends to decelerate the sheets and prevents them from prematurely being stripped from their pockets. Sheets are delivered to the pockets 32 at a velocity which is greater than the velocity of the tips **31*a* of the fingers 31 to assure that that the sheets will enter deeply into each cooperating pocket. A detailed description of the second acceleration means comprised of rollers 26 and 27** and the stacker wheel assemblies is set forth in co-pending application, Ser. No. 13,558 filed Feb. 21, 1979 and assigned to the assignee of the present invention. For this reason, a detailed description of the operation of the aforesaid components will be omitted herein for purposes of simplicity, the mode of operation being incorporated herein by reference to the aforesaid application, Ser. No. 13,558.

Sheets entering into the aforesaid pockets 32 are stripped from the pockets by means of a stripper plate 33 through which the fingers 31 pass but which prevent the passage of sheets, causing the sheets to be stripped from their pockets and thereby collect on the upper surface of plate 34 containing opening 33. Plate 34, together with a slidable guide plate 35, forms an outfeed tray for collecting and neatly stacking sheets fed thereto to facilitate their simple and rapid removal from the document handling and counting apparatus.

The rotating members 14, 17, 18, 25, 26 and 29 are all driven through a suitable drive train (not shown) by means of a single motor 36, housed within the sheet handling and counting apparatus.

In the preferred embodiment a pair of stripper assemblies 30, 30' and cooperating feed rollers 17, 17' are employed. Only one such cooperating assembly will be described for purposes of simplicity.

Turning now to a detailed consideration of the stripper assembly 30 and cooperating feed roller 17, and considering FIGS. 2, 3 and **3*a* in combination with FIG. 1, the stripper assembly 30 can be seen to include an elongated shaft 41. Bearings 43*a* and 43*b* rotatably support shaft 41 within the side plates 42*a* and 42*b* forming the supporting frame of the document handling and counting apparatus 10. Shaft 41 extends through side plate 42*a* as shown. An elongated arm 44 having an opening 44*a* for receiving the left-hand end of shaft 41 is provided with a cooperating threaded opening for receiving set screw 45 to secure arm 44 to shaft 41. The opposite end of arm 44 is provided with an opening 44*b* for receiving a pin 46 having a conical shaped top 46*a* and a cylindrical shaped body portion 46*b*. A helical spring 47 is positioned at the bottom of opening 44***b* to urge pin 46 upwardly against the under surface of an adjustable lead screw 48 having a threaded portion 48*a* which threadedly engages a tapped aperture 49*a* in a mounting block 49. Shaft 48 functions as a linearly adjustable lead screw and is provided with a knob 50 fixedly secured to the upper end of the lead screw 48. The upper end of lead screw 48 extends through a cover member 51, only a portion of which is shown in FIG. 3. The knob 50 is positioned immediately above the surface of cover member 51. Knob 50 is preferably provided with an arrow or other like indicia 50*a* which cooperates with graduations 51*a* provided on the upper surface of cover portion 51 immediately adjacent to the perimeter of knob 50 in order to facilitate axially adjustable positioning of lead screw 48 to adjust the gap distance between the stripper members 31 and their cooperating feed rollers 17, as will be more fully described.

Lead screw 48 is further provided with a pair of pins 52*a* and 52*b* preferably arranged along a common diameter of lead screw 48 and cooperating with a stop pin 53 extending upwardly from mounting block 49 to limit the rotation of lead screw 48 to a maximum angle of 180 degrees. A helical spring 54 has its upper end secured to mounting block 49 and has its lower end secured to the free end of arm 44 at 54*a*.

The operation of the adjusting means is as follows:

Rotating knob 50 clockwise as shown by arrow A causes lead screw 48 to be moved vertically downward as shown by arrow A1 causing arm 44 to rotate counterclockwise as shown by arrow A2. Spring 54 normally urges shaft 41 and arm 55 carrying stripper block 31 clockwise thereby urging stripper block 31 toward feed roller 17. The free end of arm 44 follows the linear movement experienced by lead screw 48 due to spring 54 which normally urges arm 44 in the clockwise direction as shown by arrow B2 until pin 46 abuts against lead screw 48.

Rotating knob 50 in a direction shown by arrow B causes lead screw 48 to move upwardly as shown by arrow B1. Spring 54 rotates arm 44 in the direction shown by arrow B2 and thereby simultaneously rotates shaft 41 and arm 55 in a direction shown by arrow B2 to move the stripper member 31 toward feed roller 17. As was mentioned hereinabove, lead screw 48 is limited to rotating through an angle of 180 degrees by means of pins 52*a* and 52*b* and cooperating stop pin 53. Obviously, any other limit on the angle of rotation could be provided from as great as 360 degrees (or more) to as little as 90 degrees (or less), for example. Obviously, the pitch of the threaded portion 48 may also be varied to obtain a desired amount of linear movement of lead screw 48 relative to the rotational angle through which it is designed to move. In one preferred embodiment the knob 50 and lead screw 48 is limited to movement through an angle of 180 degrees for adjustment of a gap distance between the stripper member 31 from 0 to a maximum of the order of 0.012 inches. Obviously, any other gap range may be provided if desired to accommodate sheets of greater thickness, without departing from the spirit and scope of the present invention.

As can best be seen from a consideration of FIG. 2, in actuality a pair of stripper members 31 and 31' are provided, each forming part of an assembly 30 and 30'. Since the assemblies 30 and 30' are substantially identical to one another, only one such assembly will be described herein for purposes of simplicity. Assembly 30' has been identified with like but primed designating numerals.

Assembly 30, as has been already described, includes an arm 55 having an opening 55*a* for receiving shaft 41. A set screw 56 is provided in a tapped opening 55*b* in arm 55 to secure arm 55 to shaft 41.

The free end of arm 55 has an opening 55*c* for receiving an elongated common shaft 56 which extends through both arm 55 and 55'. C-clips 57 and 57' limit the movement of shaft 56 relative to arms 55 and 55'. Set screws 58 and 58' lock common shaft 56 to arms 55 and 55'.

A helical torsion spring 59 extends about common shaft 56 and has a first arm 59*a* abutting against pin 56*a* secured to common shaft 56. The opposite arm 59*b* of torsion spring 59 is bent over the top surface of stripper mounting block 60 so as to urge the stripper mounting block member 60 in the counterclockwise direction as shown by arrow C in FIG. 3 and further as shown in FIG. 1.

Stripper mounting block 60 is further provided with a notched portion 60*a* dividing the rearward portion of the block 60 into a pair of arms 60*b* and 60*c*. The upper arm 60*b* is provided with a set screw 61 which threadedly engages a tapped opening in upper arm 60*b* so that the lower end of screw 61 is positioned to engage a stop pin 62 extending outwardly from arm 55 and into the notch 60*a*. Note especially pin 62' of FIG. 3. Set screw 61 cooperates with stop pin 62 to limit the amount of rotation experienced by stripper mounting block 60 in the counterclockwise direction represented by arrow C.

Stripper mounting block 60 is further provided with a tapped opening 60*d* which receives and threadedly engages a threaded fastening member 64. The threaded fastening member 64 extends through a larger diameter opening 31*a* in stripper member 31, which narrows to a smaller diameter opening 31*b* in member 31 so that the head 64*a* of fastening member 64 rests upon the shoulder 31*c* between large and narrow diameter openings 31*a* and 31*b* in order to securely fasten stripper member 31 to the underside of stripper mounting block 60.

The stripper members 31 and 31' can be seen to be significantly wider than their stripper mounting blocks 60, 60' and they are further provided with an elongated recess 31*d* which enables the bottom portion of the stripper mounting block 60 to be positioned within the recess 31*d* to thereby simply and yet accurately locate and position the stripper member 31 relative to the mounting block 60.

It is further clear from FIG. 2 that each stripper block 31 and 31' is of a width substantially equal to the width of its cooperating feed roller 17, 17'. The stripper members 31 and 31' are formed of a suitable resilient material of a durometer sufficient to provide a coefficient of sliding friction effective in preventing double fed documents from being passed between the stripper member 31 and its cooperating feed roller 17 (by imposing a drag upon the sheet) and yet small enough to assure that single fed documents passing between the stripper block 31 and its cooperating feed roller 17 will be passed therethrough without being damaged or torn.

The feed rollers 17 and 17' are preferably formed of a resilient material having a durometer sufficient to provide a coefficient of friction which is greater than that provided by the materials of stripper members 31 and 31' to achieve the above mentioned objectives. In order to further assure that the feed rollers 17, 17' have sufficient resiliency, their sheet driving surfaces may be formed to provide a toothed surface configuration represented for example by the teeth 17*a* in FIGS. 1, 2 and 3.

The upstream surface 31*e* of the stripper block 31 is inclined at an angle relative to the feed path which inclination serves to shape the lower portion of the stack S of sheets to facilitate feeding of the sheets between the stripper member 31 and cooperating feed roller 17 to perform the feeding and stripping operation. In addition thereto, the specific angle of the upstream surface 31*e* is selected to be small enough to prevent single-fed documents from being rebounded off surface 31*e* and yet large enough to prevent a plurality of documents from being wedged between stripper block 31 and feed roller 17. The preferred angle lies within the range from 30 to 45 degrees.

Operation of the stripper assemblies 30, 30' is as follows:

A stack S of sheets is deposited in the infeed hopper 11. Eccentric member 14*a* of the constantly rotating picker wheel 14 "jogs" the stack S and moves the bottommost sheet in stack S into the tapered throat portion of 12*b* and 13*b* of guide plates 12 and 13.

The frictional contact between adjacent sheets in stack S cause the advancement of a group of the bottommost sheets into the aforesaid throat region. The forward or downstream edges of the sheets in stack S which enter into the aforesaid tapered throat region engage inclined surface 13*b* as well as the inclined upstream surfaces 31*e* and 31*e'* of stripper members 31 and 31', which surfaces shape the last mentioned group of sheets prior to their movement beneath stripper members 31 and 31' and upon the feed rollers 17 and 17'. The inclined angle of surfaces 31*e*, 31*e'*, which is between 30 and 45 degrees, is chosen to prevent the documents from becoming wedged between the stripper members 31 and 31' and the feed rollers 17 and 17' and also prevent the sheets from bouncing or rebounding off the inclined surfaces which would occur if the angle is greater than 45 degrees.

Setting of the adjustable members including lead screw 48 and set screws 61 and 61' (see FIG. 3) precisely locate the bottommost surfaces 31*f* and 31*f'* of stripper blocks 31, 31' relative to the adjacent driving surfaces of the feed rollers 17 and 17'. Single adjustment is made by manipulation of control knob 50. Independent adjustments of each stripper member 31, 31' are accomplished by adjustment of the set screws 61, 61' cooperating with the stop members 62, 62' for independent positioning of each of the stripper assemblies 30, 30' to compensate for any differences in component tolerances and the like of the stripper assemblies as well as compensating for any differences in thickness or other irregularities of the sheets being handled. Torsion springs 59, 59' maintain the stripper block mounts 60, 60' against their respective stop members 62, 62'.

The surfaces 31*f*, 31*f'* are preferably maintained at a predetermined gap distance from the confronting surfaces of rollers 17, 17' which gap distance prevents rolling or frictional engagement between stripper members 31 and 31' and feed rollers 17 and 17' in the absence of sheets being fed therebetween to prevent premature wearing. The aforesaid gap distances are preferably less than the thickness of one of the sheets being handled by the apparatus 10 in order to assure good stripping operation. The stripper members 31 and 31' are preferably formed of a suitable resilient material such as a rubber or rubber-like material. Similarly, the feed rollers 17 and 17' have at least their surface portions formed of a resilient rubber or rubber-like material with durometers of the stripper members 31, 31' being different from the durometer of the feed rollers 17, 17' such that the coefficient of sliding friction between a sheet and the feed rollers 17, 17' is greater than the coefficient of sliding friction between the sheets themselves and between the top sheet and the stripper members 31, 31'. This arrangement assures that only single fed documents will move into the influence of the cooperating acceleration wheel 18 and idler 19 and to restrain the upper sheet of a pair of double fed sheets from moving between rollers 18, 19 for a period sufficient to allow the lower of the two double fed sheets to pass beyond the cooperating surfaces of the stripper members 31, 31' and the feed rollers 17, 17'.

In the event that a group of sheets become stuck together due to the presence of some foreign material, the resiliency of the torsion springs 59, 59' allows the stripper members 31, 31' to swing counterclockwise under the influence of the increased thickness of the group of sheets which are stuck together to thereby prevent the stripper assemblies 30, 30' and feed rollers 17, 17' from being damaged. The precision adjustments which may be made through movement of the control knob 50, as well as set screws 61,61', allow the apparatus 10 to be adjusted from one extreme of being capable of literally tearing off the top of the single tap card to the opposite extreme of allowing two thin, fragile sheets stuck together due to the presence of some foreign sticky material, to be fed between stripper blocks 31, 31' and feed rollers 17, 17' without tearing either of the fragile sheets.

In the event that it is desirable to clear documents or foreign material which may become jammed in the apparatus 10, this may be simply and readily done through the manipulation of an elongated operating arm 62 secured to a collar 63 which, in turn, is locked to shaft 44 by set screw 64. By manipulating handle 62 to rotate shaft 44 in a direction shown by arrow 65, shown in FIG. 2, the stripper members 31, 31' may be lifted and displaced a distance above their feed rollers 17, 17' to clear any foreign matter from the apparatus 10 or perform any other maintenance or inspection of the apparatus.

The present invention also encompasses an alternate embodiment for use with relatively limp documents so that they are somewhat stiffened and can be moved more easily through rollers 17, 17' and stripper blocks 31, 31'. More particularly, a stiffening member 70 (shown in dotted lines) may be added which includes four guide fingers 70*a*, 70*b*, 70*c*, and 70*d*. Stiffening member 70 is about ten thousandths of an inch thick and formed of resilient spring steel. Accordingly, when these guide fingers engage a document passing through the rollers 17, 17' and stripper blocks 31,31', they operate to add stiffness to limp documents by corrugating them in the direction of feed. Such corrugations provide a degree of stiffness to normally limp documents so that they can be more easily transferred. However, such guide fingers are biased upwardly and out of the way when stiff documents are being fed.

Although this invention has been described with respect to its preferred embodiments, it should be understood that many variations and modifications will now be obvious to those skilled in the art, and it is preferred, therefore, that the scope of the invention be limited, not by the specific disclosure herein, but only by the appended claims.

What is claimed is:

1. Sheet handling means comprising:

a plate for supporting a stack of sheets;

feed means for advancing sheets in a first direction;

jogging means extending through said plate for advancing at least the sheet at the bottom of the stack towards said feed means;

stripper means positioned adjacent and above said feed means and normally urging sheets passing said stripper means into engagement with said feed means;

said stripper means including a first inclined surface aligned transverse to said plate for engaging the leading edges of sheets in the stack to conform to said inclined surface, and a substantially flat stripping surface and a curved surface portion between said inclined surface and said stripping surface;

means for swingably mounting said stripper means;

first bias means normally urging said mounting means in a first direction for urging said stripper means towards said feed means; and second bias means coupled between said stripper means and said mounting means and being yieldable independently of said first bias means to enable said stripper means to swingably move upon said mounting means to be displaced from said feed means by sheets passing between said stripper means and said feed means.

2. The sheet handling means of claim 1 further comprising a swingably mounted stripper arm movable about a predetermined axis;

said mounting means pivotally mounting said stripper means upon said swingably mounted stripper arm a spaced distance from said predetermined axis.

3. The sheet handling apparatus of claim 2 wherein said stripper means comprises a resilient stripper member;

said first bias means urging said arm in a first angular direction; and said second bias means urging said stripper member in a second angular direction opposite said first angular direction.

4. The sheet handling apparatus of claim 2, wherein said stripper means comprises a rigid mounting member and a resilient stripper member secured to said rigid mounting member, the upstream surface of said rigid mounting member and said resilient mounting member collectively defining said inclined surface forming an acute angle with said plate for shaping a stack of sheets arranged upon the sheet handling apparatus.

5. The sheet handling apparatus of claim 4 wherein said acute angle lies in a range between 25° and 50°.

6. The sheet handling apparatus of claim 5 wherein said range is preferably between 30° and 45°.

7. The sheet handling apparatus of claim 2 further comprising means;

said stripper means further comprising abutting means swingable with said stripper arm; and said first bias means normally urging said abutting means against said stop means to thereby adjust the position of said stripper means relative to said feed means.

8. The sheet handling means of claim 7 wherein said stop means is adjustable to vary the displacement of said stripper means relative to said feed means.

9. The sheet handling means of claim 7 wherein said stop means includes a rotatable adjustment member for moving said stop means in a first direction when rotated in a first direction and for moving said stop means in a second direction when rotated in a second direction.

10. The sheet handling means of claim 9 further comprising means for limiting the angle through which said adjustment member may be rotated to limit its angular movement.

11. The sheet handling means of claim 2 further comprises stop means mounted upon said stripper arm;

said second bias means normally urging said stripper means against said stop means to limit the swinging movement of said stripper means towards said feed means.

12. The sheet handling means of claim 11 wherein said stripper means further comprises adjustable means for adjusting the swinging movement experienced by said stripper means relative to said stop means.

13. The apparatus of claim 2 further comprising a swingably mounted manually operable handle coupled to said stripper arm and movable in a first direction for moving the stripper means away from said feed means to facilitate maintenance and inspection.

14. The sheet handling means of claim 1 wherein said second bias means normally biases said stripper means to move in a direction towards said feed means and which enables said stripper means to be yieldably displaced from said feed means by sheets moving therebetween.

15. The sheet handling apparatus of claim 1 wherein said feed means comprises a feed roller positioned beneath said stripper means;

the stripper surface of said stripper means being positioned adjacent to said feed roller.

16. The sheet handling apparatus of claim 15 wherein said feed roller is resilient to yield in a direction transverse to said feed direction.

17. The sheet handling apparatus of claim 15 wherein the surface of said feed roller confronting said stripper means has a sawtooth configuration.

18. The sheet handling means of claim 1 further comprising a first shaft;

an arm swingable about said shaft;

a second shaft supported by said arm a predetermined distance from said first shaft;

said stripper means comprising a non-resilient stripper mounting member pivotally mounted upon said second shaft and having a mounting portion extending toward said feed means; and a resilient stripper member releasably joined to the mounting portion of said non-resilient stripper mounting member and extending downwardly toward said feed means.

19. The sheet handling means of claim 18 wherein said second shaft is provided with a stop member; said second bias means comprising a torsion spring encircling said second shaft and having first and second ends respectively engaging said nonresilient stripper mounting member and said stop member for urging said stripper member towards said feed roller.

20. The sheet handling means of claim 1 further comprising an infeed hopper cooperating with said plate for supporting a stack of sheets;

said stripper means having an inclined shaping surface engaging the forward edges of a group of sheets near the bottom of said stack and urging the forward edges of said group of sheets to collectively define an inclined surface conforming to the inclined shaping surface of said stripper means.

21. The sheet handling means of claim 20 wherein said stripper means has a bottom surface facing said feed means; and a curved surface joining said inclined surface and said bottom surface forming a skid-like shape for guiding the bottommost sheet in the stack towards said feed means as it moves beneath said stripper means.

22. The sheet handling means of claim 1 further including sheet stiffening means comprising one or more thin resilient fingers cooperating with said feed means for corrugating only very thin, limp sheets to stiffen said sheets and thereby facilitate the feeding operation, said fingers being moved away from said feed means by stiff sheets.

23. Sheet handling means comprising:

supporting means for supporting a stack of sheets;

feed means for advancing sheets in a first direction;

jogging means mounted upon said mounting means for advancing at least the sheet at the bottom of the stack towards said feed means;

stripper means positioned adjacent and above said feed means and normally urging sheets passing said stripper means into engagement with said feed means;

said stripper means including a first inclined surface aligned transverse to said plate for engaging the leading edges of sheets in the stack to conform to said inclined surface, and an elongated stripping surface engaging sheets as they move past said inclined surface;

means for swingably mounting said stripper means about a predetermined axis of rotation;

first bias means normally urging said mounting means in a first direction for urging said stripper means towards said feed means;

second bias means arranged on said mounting means and being yieldable to enable said stripper means to swingably move upon said mounting means to be displaced from said feed means by sheets passing between said stripper means and said feed means; and said stripper surface being positioned downstream relative to said predetermined axis of rotation to enable said stripper means to rapidly move away from said feed means in the event of a jam between said feed means and said stripper means.

24. The sheet handling apparatus of claim 23, wherein said feed means comprises a feed roller positioned beneath said stripper surface and downstream relative to the axis of rotation of said stripper means.

25. The sheet handling apparatus of claim 23 wherein said inclined surface is downstream relative to the axis of rotation of said stripper means.

* * * * *

UNITED STATES PATENT AND TRADEMARK OFFICE

CERTIFICATE OF CORRECTION

PATENT NO. : 4,313,598

DATED : February 2, 1982

INVENTOR(S) : DiBlasio

It is certified that error appears in the above—identified patent and that said Letters Patent is hereby corrected as shown below:

In Column 3, line 37, "is" should read --be--.

In Column 10, line 28: "tap" should read --tab--.

In Column 11, line 59, after "comprising" insert --stop--.

Signed and Sealed this

Third Day of May 1983

[SEAL]

*Attest:*

GERALD J. MOSSINGHOFF

*Attesting Officer*

*Commissioner of Patents and Trademarks*